United States Patent [19]

Schneider

[11] Patent Number: 4,952,089

[45] Date of Patent: Aug. 28, 1990

[54] WRITING IMPLEMENT

[75] Inventor: Roland Schneider, Tennenbronn, Fed. Rep. of Germany

[73] Assignee: Gebr. Schneider GmbH, Tennebronn, Fed. Rep. of Germany

[21] Appl. No.: 254,192

[22] Filed: Oct. 5, 1988

[30] Foreign Application Priority Data

Jan. 30, 1988 [DE] Fed. Rep. of Germany ..... 3802746

[51] Int. Cl.[5] ..... B43K 7/10

[52] U.S. Cl. ..... 401/216; 401/258; 401/199; 346/140 A

[58] Field of Search ..... 346/140 R, 140 A; 401/209, 212, 215, 216, 219, 220, 231, 232, 233, 235, 256, 258, 259, 260

[56] References Cited

U.S. PATENT DOCUMENTS

| | | | |
|---|---|---|---|
| 979,843 | 12/1910 | Grantham | 401/212 |
| 3,336,909 | 8/1967 | Diamond | 401/259 |
| 3,419,335 | 12/1968 | Bok | 401/260 X |
| 4,145,148 | 3/1979 | Fukuoka | 401/209 |
| 4,195,941 | 4/1980 | Barlow | 401/216 X |
| 4,198,172 | 4/1980 | Meislik | 401/216 X |
| 4,720,914 | 1/1988 | Maeda et al. | 346/140 R X |

FOREIGN PATENT DOCUMENTS

| | | | |
|---|---|---|---|
| 2205021 | 8/1973 | Fed. Rep. of Germany | 401/258 |
| 3529622 | 3/1986 | Fed. Rep. of Germany | 401/259 |
| 2176152 | 12/1986 | United Kingdom | 401/216 |

*Primary Examiner*—Richard J. Apley
*Assistant Examiner*—D. F. Crosby
*Attorney, Agent, or Firm*—Peter K. Kontler

[57] ABSTRACT

A writing implement for use in numerically controlled drafting machines has a tip with a front end face which is maintained at a distance of a fraction of one millimeter from the surface of a sheet of paper or another carrier of information by a portion of a ball which is rotatably mounted in a socket extending rearwardly from the front end face so that the surface of the carrier and the front end face define a capillary gap. This gap draws ink from the socket which receives ink from a channel extending into a reservoir in the housing of the implement. The channel contains several rib-shaped back supports each of which is in mere point contact with the adjacent confined major portion of the ball in the socket so as to center the ball in the socket whereby the confined major portion of the ball and the surface surrounding the socket define a capillary clearance, and to provide paths for the flow of ink from the channel into the socket. The width of the lines to be drawn on the surface of the carrier is determined by the diameter of the front end face of the tip. The front end face of the tip can be formed with radially outwardly extending capillary grooves which promote the flow of ink from the socket toward the radially outermost portions of the front end face.

20 Claims, 3 Drawing Sheets

WRITING IMPLEMENT

BACKGROUND OF THE INVENTION

The invention relates to improvements in writing implements in general, and more particularly to writing improvements in implements which can be used with advantage in numerically controlled and other automatic drafting or like machines. Still more particularly, the invention relates to improvements in writing implements of the type wherein the width of lines to be drawn on the surface of a sheet of paper or another suitable information carrier is determined by the width of the front end face of the tip of the implement and wherein the implement is provided with means for supplying a flowable medium (such as ink or India ink) to the front end face of the tip.

It is already known to provide a writing implement, particularly a drawing pen, with a tubular tip whose front end face comes in contact with the surface which is to be provided with a line. Such implements can draw lines of reasonably satisfactory quality and are often employed in numerically controlled automatic drafting machines, e.g., in those known as plotters. A drawback of implements with tips in the form of tubes which must directly engage the surface of the information carrier is that the tubes must be made of a high-quality material which can stand extensive wear. This is especially important if the lines are to be drawn on rough surfaces, such as the surfaces of unpolished or non-calendered carriers. The useful life of tubular tips is relatively short, even when the tips are made of high-quality material, if the machine is to draw lines on relatively rough surfaces. The majority of presently known tubular tips are disposable, but it is already known to provide such tips with inserts of hard metal. This contributes significantly to the initial cost of the writing implements without appreciably prolonging the useful lives of the tips when the implements are used to draw lines of rough surfaces. In such instances, even a tip with an expensive insert of hard metal must be dispensed with after a relatively short period of use.

It is further known to provide the tip of a writing implement with a ball which rolls along the surface of an information carrier and deposits thereon a layer of ink or another flowable material to thus form a line having a width depending on the width of the area of contact between the ball and the surface. The construction of these writing implements (popularly known as ball point pens) is such that nearly one-half of the ball projects from the tip of the implement, i.e., the difference between the dimensions of the confined and exposed portions of the ball should barely suffice to ensure that the ball is reliably retained in its socket. The ball deposits on the surface of a carrier a flowable medium which is normally of pasty consistency, and the width of the line depends upon the force with which the exposed portion of the ball is urged against and deforms the material of the carrier.

It was further proposed to design a ball point pen in such a way that the ball is mounted for forward and rearward movement in the tip of the housing of the implement and is biased forwardly by a spring. Such implements, also called and/or used as marking pens, are disclosed, for example, in German Auslegeschrift No. 1 209 912 of Schwarzäugl, in U.S. Pat. No. 1,563,408 to Sutherland, in German Offenlegungsschrift No. 25 59 158 of Chaumet and in French Pat. No. 950.038 to Roussel. The purpose of the springs which bias the ball is to ensure that the pressure with which the implement is urged toward the writing or drafting surface cannot unduly influence the width or thickness of lines which are to be drawn by the exposed portion of the ball. The principle underlying the operation of the just described implements is the same as that underlying the operation of standard ball point pens, i.e., the delivery of ink onto the surface of a carrier is effected exclusively by the exposed portion of the ball and the rate of such delivery depends on a number of often unpredictable factors including the viscosity of the flowable medium, the ability of the ball to turn in the tip of the writing implement and others. The medium is or can be caused to flow toward the ball by capillary action; however, no capillary forces are involved in actual application of the medium to the surface of a carrier, such as a sheet of paper or a foil. If the front end face of the tip of a ball point pen or a like writing implement happens to contact the surface of the carrier, such contact is purely accidental.

OBJECTS OF THE INVENTION

An object of the invention is to provide a novel and improved writing implement, such as a drawing pen for use in automatic numerically controlled drafting machines, which is constructed and assembled in such a way that it exhibits all advantages of a ball point pen as well as all advantages of implements of the type wherein the width of the tip determines the width of lines to be drawn on the surface of a sheet of paper, a metallic or plastic foil or any other suitable carrier of information.

Another object of the invention is to provide a novel and improved mounting for the ball of a writing implement.

A further object of the invention is to provide a simple and inexpensive writing implement which can be used in existing drafting machines as a superior substitute for conventional implements.

An additional object of the invention is to provide a writing implement which can stand long periods of use without necessitating replacement or repair of any of its parts and which can stand long periods of use even if the lines are to be drawn on rough surfaces.

Still another object of the invention is to provide a novel and improved tip for use in the above outlined writing implement.

An additional object of the invention is to provide a writing implement which can be used to draw sharply defined lines with smooth edges and without interruptions or breaks for any desired intervals of time.

Another object of the invention is to provide a writing implement which can draw predictable lines of high quality even if its tip is caused to move along the surface of a carrier (and/or vice versa) at an elevated speed.

A further object of the invention is to provide a novel and improved method of delivering accurately metered quantities of a flowable medium (such as ink or India ink) from the source of supply in a writing implement to the locus of drawing lines on the surface of a sheet-like or otherwise configurated information carrier.

Another object of the invention is to provide a writing implement which is constructed and assembled in such a way that the force with which the implement is urged toward the carrier cannot affect, or cannot appreciably affect, the quality of lines which are drawn on the surface of the carrier.

SUMMARY OF THE INVENTION

The invention is embodied in a writing implement, particularly in a drawing pen for use in numerically controlled drafting machines, for the application of ink or another flowable medium to the surface of drawing paper, foil or another carrier. The improved writing implement comprises a tip having a preferably circular front end face whose diameter determines the width of the lines to be drawn on the surface of a carrier, and a channel which delivers flowable medium to the front end face. The writing implement further comprises at least one distancing element which is carried by the tip and projects beyond the front end face of the tip through a distance such that, when the distancing element contacts the surface of a carrier, such surface and the front end face of the tip define a capillary gap for the medium which issues from the channel. The distancing element preferably constitutes a sphere which is rotatably mounted in the tip and projects beyond the central portion of the front end face. At least that portion of the sphere which is adjacent its external surface is preferably made of a metallic material, most preferably a hard metal.

The tip is preferably formed with a socket which extends inwardly from the central portion of the front end face and receives a major portion of the sphere, preferably with capillary clearance. The outlet of the channel communicates with the socket so that the medium must flow around the confined portion of the sphere on its way toward the front end face of the tip. The latter preferably includes at least two ribs or otherwise configurated back supports which are adjacent the socket and abut the confined portion of the sphere. Each such back support can be in a mere point contact with the sphere. For example, each back support can be provided with an edge face or facet which extends tangentially of and contacts the confined portion of the sphere. It is presently preferred to provide the tip with a relatively large number of back supports each of which is in a mere point contact with the confined portion of the spehere. The points of contact between the back supports and the sphere preferably form a circle with a radius which is smaller, preferably much smaller, than the radius of the sphere.

If the tip constitutes one piece of an elastically deformable material, particularly an elastic plastic material, the major portion of the sphere can be introduced into the socket by forcibly expanding the tip around the socket in the region of the front end face.

If the tip is assembled of a plurality of discrete sections, the sections can be made of a rigid plastic or other material and are preferably formed in such a way that the major portion of the sphere can be confined in the socket not later than during assembly of the sections with one another. For example, the tip can be assembled of two rigid plastic sections having concentric circular surfaces one of which surrounds and is in pronounced frictional engagement with the other surface.

The writing implement preferably further comprises a source of flowable medium (such as regular ink or India ink) which communicates (either directly or indirectly) with the inlet of the channel.

The front end face of the tip can be provided with one or more capillary grooves, e.g., with an entire array of equidistant grooves which extend radially outwardly from the exposed portion of the sphere.

The novel features which are considered as characteristic of the invention are set forth in particular in the appended claims. The improved writing implement itself, however, both as to its construction and the mode of assembling and using the same, together with additional features and advantages thereof, will be best understood upon perusal of the following detailed description of certain specific embodiments with reference to the accompanying drawing.

DESCRIPTION OF PREFERRED EMBODIMENTS

Figure 1:
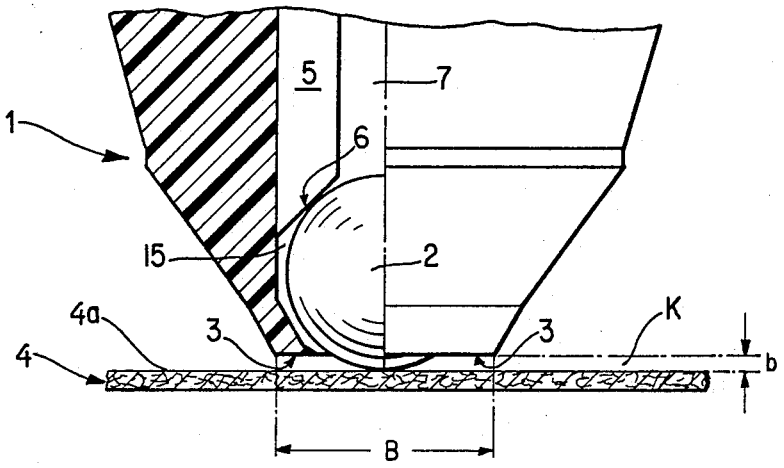
FIG. 1 is an enlarged fragmentary partly elevational and partly central sectional view of the tip of a writing implement which embodies one form of the invention, the exposed portion of the spherical distancing element being in contact with the adjacent surface of a sheet-like carrier to which the flowable medium is to be applied.
Figure 2:
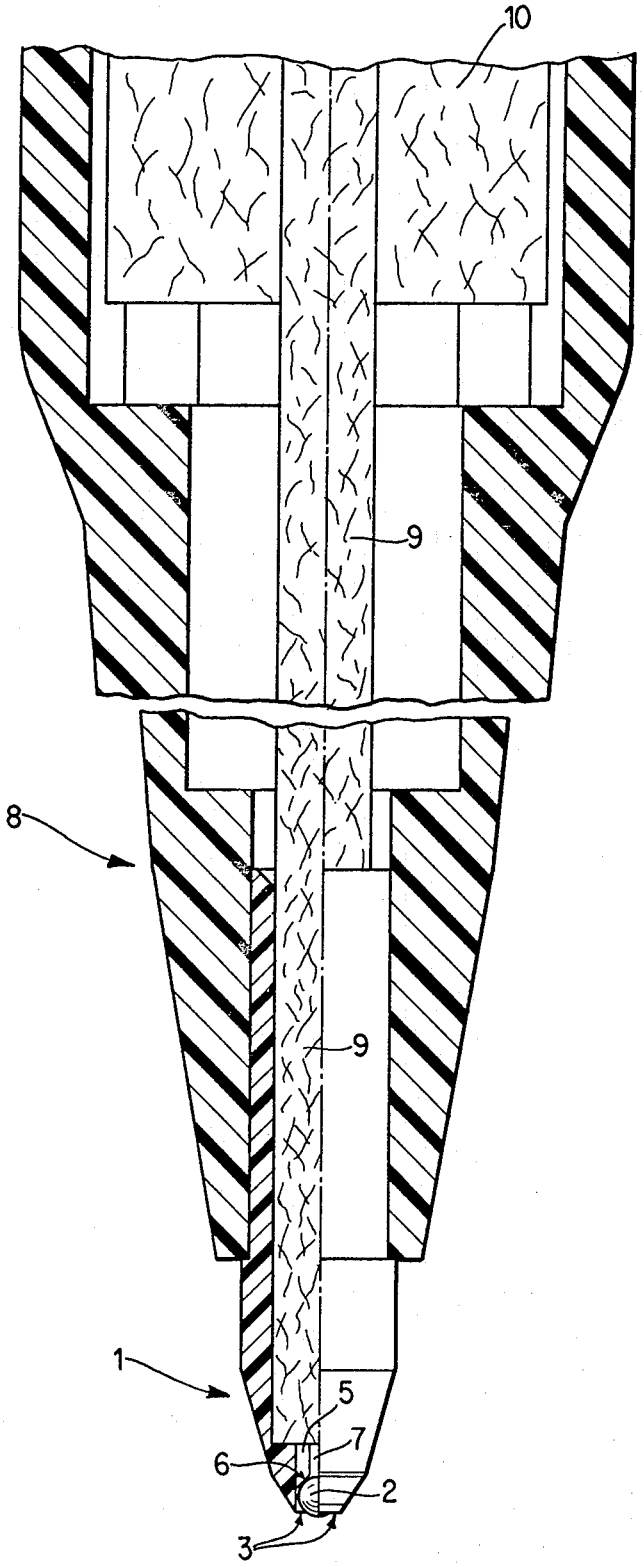
FIG. 2 is a smaller-scale view of the structure which is depicted in FIG. 1 and a central sectional view of a portion of that part of the writing implement which contains the source of flowable medium.

FIGS. 1 and 2 show a portion of a writing implement 8 which can constitute a drawing pen for use in a numerically controlled drafting machine. The implement 8 has a front end portion or tip 1 having a circular front end face 3 with a diameter which determines the width of one or more lines to be drawn on the surface 4*a* of a sheet-like or any other suitable carrier 4 of information. The carrier 4 can constitute a solid or flexible panel or sheet of drawing paper, metallic or plastic foil, wood or the like. The central portion of the front end face 3 of the tip 1 is provided with a recess or socket 15 for the major portion of a rotary (preferably spherical) distancing element 2 (hereinafter called ball for short) which projects beyond the front end face 3 so that, when the implement 8 is ready to draw a line along the surface 4*a*, the exposed portion of the ball 2 causes the front end face 3 and the surface 4*a* to define a capillary gap K having a width b such as to ensure that a flowable writing medium (for example, ink or India ink) will flow from the capillary clearance between the major portion of the ball 2 and the tip 1 into the gap K in accordance with the laws of capillary movement and will form a thin film having a width B corresponding to the diameter of the front end face 3. The width of capillary clearance between the ball 2 and the tip 3 on the one hand, and of the gap K between the front end face 3 and the surface 4*a* on the other hand, is greatly exaggerated in FIG. 1 for the sake of clarity.

That (major) portion of the ball 2 which is confined (with capillary clearance) in the socket 15 of the tip 1 abuts the front edge faces 6 of at least two (but preferably more) back supports 5 which are preferably integral with the tip 1 and are disposed in an elongated medium-supplying channel 7 (hereinafter called ink channel) having a discharge end or outlet which delivers flowable medium into the socket 15 so that such medium must flow around (and lubricates) the confined major portion of the ball 2 prior to entering the capillary gap K between the front end face 3 and the surface 4a of the carrier 4. The front edge faces 6 of the back supports 5 are preferably tangential to the adjacent portions of the ball 2 so that each back support 5 can be said to be in a mere point contact with the ball. The points of contact between the edge faces 6 and the ball 2 preferably form a circle with a radius which is smaller (preferably much smaller) than the radius of the ball 2.

The medium (hereinafter called ink) which flows in the channel 7 finds a plurality of paths between the back supports 5 on its way into the socket 15 wherein it flows around the confined major portion of the ball 2 prior to entering the capillary gap K. As a rule, or in many instances, the writing implement 8 will or can be held in upright position so that the tip 1 is located at its lower end. This promotes the flow of ink in the channel 7 toward and into the capillary gap K. The capillary clearance between the confined portion of the ball 2 and the surface bounding the socket 15 suffices to prevent the ball from jamming in the tip 1 as well as to ensure that ink can readily flow toward and into the gap K when the implement 8 is in actual use. At the same time, ink which flows into the socket 15 lubricates the front edge faces 6 of the back supports 5 and the adjacent portions of external surface of the ball 2 so as to even further reduce the likelihood of jamming of the ball in the tip 1. At least that portion or layer of the ball 2 which is adjacent its external surface is preferably made of a metallic material, most preferably a hard or very hard metallic material such as steel. On the other hand, the tip 1 or the entire body or housing of the implement 8 can be made of a plastic material. While the plastic material of the major portion of the body or housing of the implement 8 can be rigid or practically rigid, that portion of the tip 1 which immediately surrounds the socket 15 is preferably elastic so that it can expand during forcible insertion of the major portion of the ball 2 into the socket 15.

An important advantage of the improved writing implement 8 is that, contrary to the operation of ball point pens, the width B of the line which is being drawn by the implement on the surface 4a or on the surface of another carrier, is not determined by the extent of contact between the ball 2 and the surface 4a but rather by the width (diameter) of the preferably circular front end face 3 of the tip 1. It has been found that the implement 8 can draw lines having sharply defined and very smooth edges even if the front end face 3 has a relatively large diameter (B). It was further ascertained that such sharply defined lines having a width B can be drawn on all kinds of carriers including sheets of paper, metallic or plastic foils and the like. The lines on such carriers are sharply defined and are not interrupted, even if the implement 8 is moved along the surface 4a at an elevated speed. This is attributable to the fact that the back supports 5 cause the ball 2 to project beyond the front end face 3 to a predetermined extent which is conducive to the establishment of a capillary gap K and hence to a highly predictable flow of ink from the channel 7 into the socket 15 and thence to the front end face 3. The width B of the line which is being drawn by the implement 8 remains constant after short or long periods of use of the implement, and the quality of the line (i.e., the sharpness of its edges and the absence of interruptions) remains unchanged. Another reason for such high quality of lines which can be drawn with the improved implement 8 is that the front end face 3 normally does not and need not come in actual contact with the surface 4a of the carrier 4, i.e., the wear upon the front end face 3 is practically nil. Since at least the outer layer of the ball 2 is made of a strongly wear-resistant material, the useful life of the ball is very long. The useful life of the ball 2 is not unduly shortened even if the implement 8 is used to draw lines on rough surfaces of abrasive material, such as unpolished or uncalendered surfaces of foils or like carriers. While it is possible to employ a distancing element which is rigid with and simply projects beyond the front end face 3 of the tip 1, a rotary or rolling distancing element (particularly a ball) is preferred in many or most instances because it can travel over the surface 4a with a minimum of friction, especially if the major portion of such ball is mounted in the socket 15 in the aforedescribed manner so that it is received in the socket with capillary clearance and is in a mere point contact with at least two back supports. Each of the back supports 5 can constitute or resemble a narrow rib or fin which extends in parallelism with and is disposed in the outlet of the ink channel 7.

FIG. 2 shows that the main portion of the body or housing of the writing implement 8 contains a source 10 of supply of ink, and that such source of supply communicates with the inlet of the ink channel 7. The character 9 denotes a fibrous ink conductor which acts not unlike a wick and can be received in the channel 7 (or can convey ink from the source 10 to the inlet of the channel). If desired or necessary, the entire source 10 can contain a supply of fibrous ink conductor material a rope-like portion of which extends toward the tip 1 to form the conductor 9. Alternatively, the source 10 can include an ink-containing cartridge of any known design which can be readily replaced when the supply of ink therein is exhausted.

The front edge faces 6 of the back supports 5 for the major portion of the ball 2 can perform an additional useful function, namely that of centering the ball 2 in the socket 15 so that the locus of contact between the exposed portion of the ball 2 and the surface 4a is disposed exactly at the center of the front end face 3 when the implement 8 is in use.

As mentioned above, the improved implement 8 can be used with particular advantage in numerically controlled automatic drafting or other machines. However, it is equally possible to guide the exposed portion of the ball 2 along the surface 4a by hand. To this end, the draftsman will grasp the major portion of the body or housing of the implement 8 or will resort to a handle which is affixed to the implement 8 and facilitates accurate guidance of the ball 2 along a preselected path. The implement 8 can be used for the making of engineering and other technical drawings, for the application of letters, numerals and/or other characters with assistance from suitable patterns, for drawing lines along rulers and other types of drafting tools, and for many other purposes where it is desirable or necessary to draw straight or curved lines with sharply defined edges and without breaks. The implement 8 is relatively inexpensive and comprises a small number of parts. It can be provided with a replaceable tip 1 or with a tip which is integral with the main portion of the housing of the implement but with a replaceable ball and with a replenishable or replaceable source of ink. Sharply defined relatively wide or narrow lines can be drawn on all kinds of surfaces including very smooth (e.g., highly polished and calendered) surfaces as well as rough or extremely rough surfaces, either by hand or by resorting to a machine which steers the implement 8 in accordance with a pattern or program.

Another important advantage of the improved writing implement 8 is that the front end face 3 of the tip 1 need not (and normally should not) contact the surface 4*a* of the carrier 4. This is in contrast to the operation of the aforedescribed conventional implements which employ tubes with front end faces which come in actual contact with the surface of the carrier. In this respect, the improved writing implement acts more like a ball point pen because the exposed portion of the ball 2 is invariably in contact with the surface 4*a* when the implement 8 is in use. However, the improved implement does not rely on the ball 2 for the application of flowable medium to the surface 4*a*; such function is performed by capillary attraction which ensures that the gap K is filled with flowable medium when the implement 8 is in use so that the width B of lines which are drawn on the surface 4*a* is determined exclusively by the diameter of the front end face 3. The purpose of the ball 2 is to maintain the front end face 3 out of contact with the surface 4*a* (in order to prevent the tip 1 from undergoing wear in actual use of the implement 8) as well as to ensure the establishment of the capillary gap K. Since the tip 1 is not subject to wear, it can be made of an inexpensive material and need not be machined with a high degree of precision, as long as the diameter (B) of its front end face 3 matches the desired width of lines to be drawn on the surface 4*a* and as long as it can properly retain the major portion of the ball 2 in such a way that the confined portion of the ball and the surface surrounding the socket 15 define a relatively narrow (preferably capillary) clearance for the flow of ink from the outlet of the channel 7 toward the front end face 3. The width b of the capillary gap K is normally a minute or small fraction of one millimeter. Eventual wear upon the ball 2 cannot unduly affect the width b of the capillary gap K because the ball rotates when the implement 8 is in use so that the wear upon the ball is uniform and its diameter decreases gradually, i.e., the width b will be reduced below a minimum permissible value only after extensive use of the implement 8 for the application of lines to rough surfaces.

As mentioned above, the ball 2 can be replaced with a roller- or barrel-shaped distancing element or even with a distancing element which is fixedly installed in or is made integral with the tip 1. However, a rolling or rotary (particularly spherical) distancing element is preferred at this time for a number of reasons, such as pronounced reduction of wear, ability to be lubricated by the flowable medium which is delivered by the channel 7, and uniformity of wear (if any) to thus ensure that the implement 8 can be used for long periods of time before the width b of the capillary gap K is reduced below the minimum acceptable value. Still further, a spherical distancing element can properly guide the implement 8 along a smooth or rough surface 4*a* and can be mass-produced at a low cost to thus contribute to low cost of the entire implement. As a rule, the exposed portion of the ball 2 is in a mere point contact with the surface 4*a*.

The placing of the socket 15 at the center of the front end face 3 also constitutes a desirable and advantageous feature of the improved writing implement 8. This facilitates the establishment of a gap K whose width b is constant along the entire front end face 3 as long as the axis of the tip 1 is normal to the plane of the surface 4*a* as well as that the medium issuing from the socket 15 must cover identical distances while flowing from the socket toward the radially outermost portions of the front end face 3. This, in turn, ensures that the width or thickness of the line which is being drawn on the surface 4*a* will not change if the implement 8 is caused to change the direction of its movement. Such directional changes can be carried out as often as desired and at rapidly following intervals, either gradually or abruptly, because the ball 2 is free to rotate in its socket 15 and is continuously lubricated by the flowable medium so that its resistance to changes of direction of movement of the implement 8 relative to the carrier 4 is always the same.

The gap K draws the flowable medium from the socket 15 by capillary attraction and thus ensures the drawing of a line of predetermined width and with smooth edges as well as without breaks or interruptions irrespective of the width of the line and irrespective of the smoothness or lack of smoothness of the surface 4*a*. The improved implement 8 is capable of drawing highly satisfactory lines on the surfaces of foils, a feature which is not characteristic of presently known ball point pens with or without spring-biased balls.

The utilization of aforediscussed back supports 5 in the form of narrow ribs, webs or fins with edge faces 6 which are in a mere point contact with the confined portion of the ball 2 also contributes to longer useful life of the ball and of the entire writing implement. This is due to the fact the the extent of frictional engagement between the back supports 5 and the ball 2 is negligible, i.e., the wear upon the ball as a result of engagement with the edge faces 6 is minimal or nil. Moreover, and if the diameter of the circle which is formed by the points of contact between the edge faces 6 and the ball 2 is properly chosen, the back supports 5 automatically center the ball 2 in the socket 15 so that the width of the clearance between the confined portion of the ball 2 and the surface surrounding the socket 15 is constant, at least when the implement 8 is in use and the exposed portion of the ball 2 bears against the surface 4*a* so that the confined portion of the ball is automatically centered by the edge faces 6. Edge faces 6 which are tangential to the adjacent portions of the ball 2 exhibit the additional advantage that they permit the medium issuing from the channel 7 to provide such edge faces with layers of ink which act as lubricating films and further reduce friction between the ball and the back supports 5.

While it is also possible to provide the back supports 5 with concave edge faces 6 with radii of curvature matching or approximating the radius of the ball 2 in order to enhance the centering action of the back supports upon the ball, back supports with flat or convex front edge faces which are tangential to the ball (i.e., which are in a mere point contact with the ball) are preferred at this time because they contribute to longer useful life of the ball without appreciably affecting their centering action.

The tip 1 of the implement 8 can be made of a metallic material. However, and since the tip 1 undergoes a minimum of wear (at least in the region of its front end face 3), it is possible to make such tip of a relatively inexpensive plastic material. The material of the tip should be at least slightly elastic in the region around the socket 15 so as to enable the tip to expand during forcible introduction of the major portion of the ball 2 into the socket.

A tip 1 which is made of nonmetallic material is preferred in many types of automatic plotters wherein the ball 2 must rotate at a high speed when the implement is caused to move rapidly in any one of a number of directions during the making of a drawing or the like. If the material of the tip around the socket 15 is at least slightly elastic, the tip is much less likely to seize the metallic ball 2 during such operation of the drafting machine. The likelihood of seizing would be more pronounced if the ball and the tip around the ball were made of a metallic material. Elasticity of the material of the tip 1 in the region of the socket 15 and front end face 3 is not detrimental to the utility and/or useful life of the implement 8 because the front end face 3 is not required to contact, and normally does not come in actual contact with, the surface 4*a* of the carrier. A plastic tip can be mass produced in a suitable injection molding or other plastic processing machine. Such tip can form an integral part of the body or housing of the implement 8.

Figure 3:
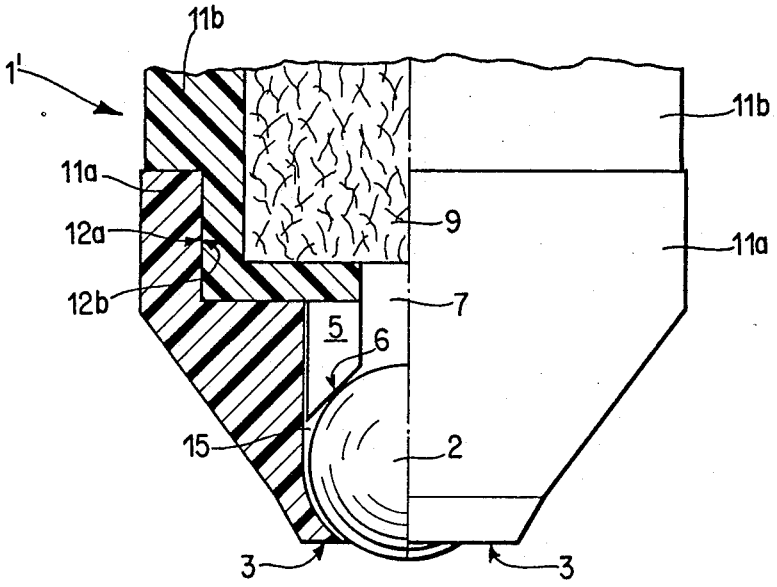
FIG. 3 is an enlarged fragmentary partly elevational and partly sectional view of a modified writing implement having a tip which is assembled of two concentric sections.

FIG. 3 shows a portion of a modified writing implement having a tip 1' which is assembled of two concentric sections 11*a* and 11*b* having concentric cylindrical or frustoconical surfaces 12*a*, 12*b*. The surface 12*a* of the section 11*a* surrounds and is preferably in pronounced frictional engagement with the surface 12*b* of the section 11*b* so as to prevent uncontrolled leakage of ink from the socket 15, i.e., to ensure that ink which has been supplied into the socket 15 can leave the tip 1' only in a direction toward the front end face 3. The extent to which a relatively small portion of the ball 2 projects beyond the front end face 3 is the same as described in connection with FIGS. 1 and 2, i.e., the front end face 3 and the surface 4*a* of a suitable carrier will again form a capillary gap corresponding to the gap K of FIG. 1, and the width of the line to be drawn with the implement embodying the structure of FIG. 3 will match the diameter (width) of the front end face 3.

An advantage of the tip 1' is that its sections 11*a* and 11*b* can be made of a rigid material (such as a suitable plastic substance). The socket 15 is formed in the front section 11*a*, and the back supports 5 are formed on the rear section 11*b*. Thus, the ball 2 can be inserted into the socket 15 before the sections 11*a*, 11*b* are assembled by introducing the surface 12*b* into the space which is surrounded by the surface 12*a*.

The tip 1' of FIG. 3 can be used with particular advantage in implements which employ small or very small balls 2. It would be difficult to ensure proper retention of a small-diameter ball in a socket which is surrounded by an elastically deformable material.

Figure 4A:
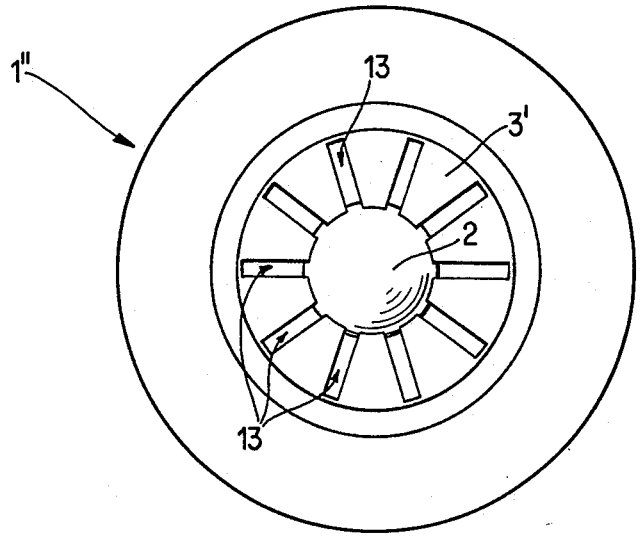
FIG. 4*a* is a front end elevational view of the tip of a third writing implement wherein the front end face has a plurality of radially extending capillary grooves.
Figure 4B:
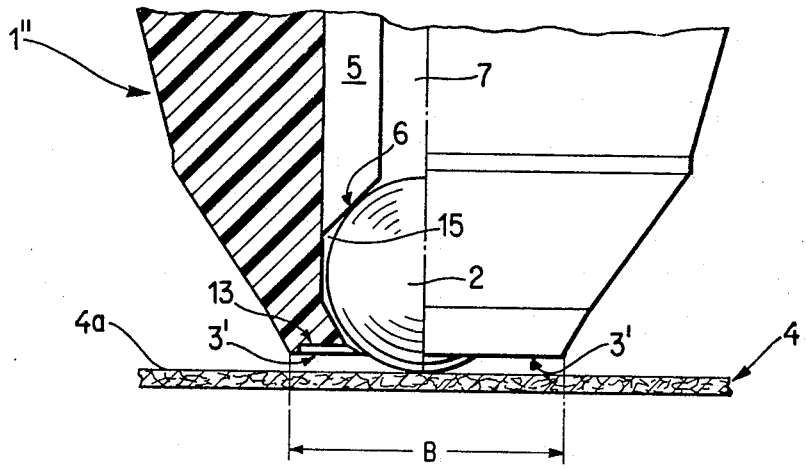
FIG. 4*b* is a partly side elevational and partly central sectional view of the tip of FIG. 4*a*, the distancing element being maintained in point contact with the surface of a sheet-like carrier.

FIGS. 4*a* and 4*b* show the tip 1'' of a third writing implement wherein the circular front end face 3' of the tip is provided with a set of equally spaced capillary grooves or recesses 13 which surround the exposed portion of the ball 2 and extend from the socket 15 toward but short of the radially outermost portion of the front end face 3'. The dimensions, particularly the width, of the grooves 13 are selected with a view to ensure capillary flow of ink therein. The grooves 13 contribute still further to the quality of lines which can be drawn with the tip 1''. Thus, the grooves 13 promote the flow of ink from the socket 15 toward the radially outermost portions of the front end face 3' to even further enhance the smoothness of both edges of a line which is being drawn on the surface 4*a* of the carrier 4 when the tip 1'' is caused to move relative to the carrier and/or vice versa. The tip 1'' can be used with particular advantage for the drawing of relatively wide lines when it is highly desirable and advantageous to promote the flow of ink from the socket 15 toward the radially outermost portions of the front end face 3'.

The tip 1'' can be modified in a number of ways without departing from the spirit of the invention. For example, the outer ends of the grooves 13 can be open, i.e., they can extend all the way to the adjacent radially outermost portions of the front end face 3'. Furthermore, the radially innermost portions of the grooves 13 can terminate short of the socket 15 without unduly affecting their inkdistributing function. Still further, the grooves 13 need not be straight and their number can be greater or less than shown in FIG. 4*a*. The grooves 13 may but need not be uniformly spaced apart in the circumferential direction of the front end face 3'.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A writing implement, particularly for use in numerically controlled drafting machines, for the application of a flowable medium to the surface of drawing paper, foil or another carrier, comprising a tip having a front end face and a channel which delivers flowable medium to said front end face, said front end face having at least one capillary groove; and at least one distancing element carried by said tip and projecting beyond said front end face through a distance such that when said element contacts the surface of a carrier, the front end face and such surface define a capillary gap for the medium which issues from said channel.

2. The writing implement of claim 1, wherein said distancing element is rotatably; mounted in said tip.

3. The writing implement of claim 2, wherein said distancing element is a sphere.

4. The writing element of claim 2, wherein said front end face has a central portion and said distancing element projects beyond the central portion of said front end face.

5. The writing implement of claim 2, wherein said distancing element has an external surface and contains a metallic material, at least in the region of said external surface.

6. The writing implement of claim 5, wherein said metallic material is a hard metal.

7. The writing implement of claim 2, wherein said tip has a socket provided in said front end face and receiving a portion of said distancing element with capillary clearance, said channel having an outlet communicating with said socket.

8. The writing implement of claim 2, wherein said distancing element is a sphere and said tip has a socket provided in said front end face and receiving a portion of said sphere, said tip including at least two back supports adjacent said socket and abutting said portion of said sphere.

9. The writing implement of claim 8, wherein each of said back supports is in point contact with said portion of said sphere.

10. The writing implement of claim 8, wherein each of said back supports has an edge face which is substantially tangential to and contacts said portion of said sphere.

11. The writing implement of claim 8, wherein said tip includes a plurality of back supports each of which is in point contact with said portion of said sphere, the points of contact between said back supports and said portion of said sphere together forming a circle having a radius smaller than the radius of said sphere.

12. The writing implement of claim 2, wherein said distancing element is a sphere and said tip has a socket for a portion of said sphere, said tip being elastically deformable in the region of said socket.

13. The writing implement of claim 12, wherein said tip consists, at least in part, of elastomeric plastic material.

14. The writing implement of claim 2, wherein said tip is a one-piece body.

15. The writing implement of claim 2, wherein said tip comprises a plurality of discrete sections.

16. The writing implement of claim 15, wherein said sections have concentric circular surfaces one of which surrounds the other thereof.

17. The writing implement of claim 2, further comprising a source of flowable medium, said channel being in communication with said source.

18. The writing implement of claim 17, wherein said source contains ink.

19. The writing implement of claim 2, wherein said front end face has at least one capillary groove.

20. The writing implement of claim 1, wherein said front end face has a circular outline and said distancing element is disposed substantially centrally of said front end face, said front end face having a plurality of capil-lary grooves extending substantially radially outwardly from said distancing element.

* * * * *